US009597888B2

(12) United States Patent
Takahashi et al.

(10) Patent No.: US 9,597,888 B2
(45) Date of Patent: Mar. 21, 2017

(54) PRINTING APPARATUS AND INK AMOUNT CONTROL METHOD FOR INK TANK

(71) Applicant: CANON KABUSHIKI KAISHA, Tokyo (JP)

(72) Inventors: Atsushi Takahashi, Tama (JP); Kei Kosaka, Tokyo (JP); Tomoyuki Tenkawa, Yokohama (JP); Naozumi Nabeshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/829,336

(22) Filed: Aug. 18, 2015

(65) Prior Publication Data

US 2016/0052290 A1 Feb. 25, 2016

(30) Foreign Application Priority Data

Aug. 25, 2014 (JP) ..... 2014-170346

(51) Int. Cl.
*B41J 2/175* (2006.01)
*B41J 29/02* (2006.01)

(52) U.S. Cl.
CPC ..... *B41J 2/17566* (2013.01); *B41J 2/175* (2013.01); *B41J 2/1752* (2013.01); *B41J 2/17509* (2013.01); *B41J 2/17596* (2013.01); *B41J 29/02* (2013.01); *B41J 2002/17579* (2013.01)

(58) Field of Classification Search
CPC ..... B41J 2/17566
USPC ..... 347/7
See application file for complete search history.

(56) References Cited

U.S. PATENT DOCUMENTS 6,834,945 B2 12/2004 Ishizawa et al. ..... 347/86
2010/0066773 A1* 3/2010 Taga ..... B41J 2/175 347/6

FOREIGN PATENT DOCUMENTS

JP 2002-192739 4/2010

OTHER PUBLICATIONS

U.S. Appl. No. 14/724,343, filed May 28, 2015; Inventors: Akira Shiba, Naozumi Nabeshima, Koichi Kubo.
U.S. Appl. No. 14/744,926, filed Jun. 19, 2015; Inventors: Yasuo Kotaki, Kenta Udagawa, Naozumi Nabeshima, Soji Kondo, Masafumi Seki.
U.S. Appl. No. 14/744,939, filed Jun. 19, 2015; Inventors: Soji Kondo, Yasuo Kotaki, Kenta Udagawa, Naozumi Nabeshima, Tatsuo Nanjo, Kazuya Yoshii.

(Continued)

*Primary Examiner* — Jason Uhlenhake
(74) *Attorney, Agent, or Firm* — Fitzpatrick Cella Harper & Scinto

(57) ABSTRACT

An inkjet printing apparatus performing a printing operation using a main tank for storing ink and a sub tank for storing the ink supplied from the main tank to supply the ink to the print head includes a detection unit for detecting the ink amount in the sub tank and an ink filling unit for driving a driving unit for supplying ink from the main tank to the sub tank to subject the sub tank to an ink filling operation. The ink filling unit is configured, when the ink amount detected by the detection unit is determined to be equal to or lower than the first predetermined amount, the second ink filling operation is performed. The second ink filling operation performs a driving longer than the drive time of the driving unit in the first ink filling operation performed when the main tank is attached to the inkjet printing apparatus.

26 Claims, 17 Drawing Sheets

(56) References Cited

OTHER PUBLICATIONS

U.S. Appl. No. 14/744,973, filed Jun. 19, 2015; Inventors: Masafumi Seki, Naozumi Nabeshima, Koichi Kubo, Kazuya Yoshii.
U.S. Appl. No. 14/829,333, filed Aug. 18, 2015; Inventors: Kei Kosaka, Atsushi Takahashi, Tomoyuki Tenkawa, Akiyoshi Sahara, Toshiyuki Kuroda, Kei Takarabe.

* cited by examiner

| INK AMOUNT IN MAIN TANK HAVING A POSSIBILITY OF THE STOPPAGE OF SUPPLY | INK AMOUNT IN MAIN TANK HAVING A POSSIBILITY OF INK LEAKAGE | INK AMOUNT IN MAIN TANK AFTER INK FILLING SEQUENCE 2 |
|---|---|---|
| 1.0g | 0.8g | 0.6g |

FIG.15

PRINTING APPARATUS AND INK AMOUNT CONTROL METHOD FOR INK TANK

BACKGROUND OF THE INVENTION

Field of the Invention

The present invention relates to a printing apparatus and an ink amount control method for an ink tank. In particular, the invention relates to a technique for preventing ink leakage via an ink supply opening or the like during the exchange of an ink tank for example.

Description of the Related Art

As an example of a configuration to prevent the ink leakage during ink exchange, Japanese Patent Laid-Open No. 2002-192739 discloses a configuration in which a connecting part between an ink chamber and an ink supply opening has a valving element for closing the ink supply opening and a communication part between the connecting part and the ink chamber further has a check valve. This configuration prevents the ink leakage through the ink supply opening when an ink tank is not connected to an ink supply pipe.

However, from the viewpoints of the cost or the reduction of components, some printing apparatuses has not the valve element and the check valve which are disclosed in Japanese Patent Laid-Open No. 2002-192739. In the case of such an apparatus, when an ink tank is removed during an ink tank exchange while an ink supply opening is being opened, outside air flows into the tank and thus negative pressure in the tank can be no more kept, thus resulting in the leakage of ink remaining in the ink tank through the supply opening.

SUMMARY OF THE INVENTION

An objective of the present invention is to provide a printing apparatus and an ink amount control method for an ink tank by which the ink leakage through an ink supply opening can be reduced in a configuration having no valve to prevent the ink leakage through an ink tank.

In a first aspect of the present invention, there is provided a printing apparatus comprising: a main tank for containing ink; a sub tank for containing ink supplied from the main tank and supplying ink to a print head; a detection unit configured to detect an ink amount in the sub tank; and an ink filling unit configured to perform an ink filling operation to the sub tank by driving a driving unit for supplying ink from the main tank to the sub tank, wherein the ink filling unit performs a first ink filling operation when the main tank is mounted to the printing apparatus and performs a second ink filling operation in which the driving unit is driven longer drive time than that in the first ink filling operation, in a case where the detection unit detects the ink amount less than a first predetermined amount.

In a second aspect of the present invention, there is provided an ink amount control method for an ink tank in an ink jet printing apparatus that performs printing using the ink tank for containing ink and supplying ink to a print head, the method comprising: a step of performing an ink discharge operation that discharges ink from the ink tank by driving a driving unit, wherein the ink discharge operation is performed by driving the driving unit longer drive time than that in an ink discharge operation performed when the ink tank is mounted to the ink jet printing apparatus.

According to the configuration described above, the ink leakage through an ink supply opening of an ink tank can be reduce in a configuration in which an inkjet printing apparatus has no valve for preventing the ink leakage through the ink tank.

Further features of the present invention will become apparent from the following description of exemplary embodiments (with reference to the attached drawings).

BRIEF DESCRIPTION OF THE DRAWINGS

FIG. 15 is a chart showing, with regard to the ink amount discharged from the main tank by the second filling step shown in FIG. 12, the remaining ink amount in the main tank having a possibility of the stoppage of the supply to the sub tank and the remaining ink amount in the main tank having a possibility of ink leakage;

DESCRIPTION OF THE EMBODIMENTS

Embodiments of the present invention will be described in detail with reference to drawings.

First Embodiment

Figure 1:
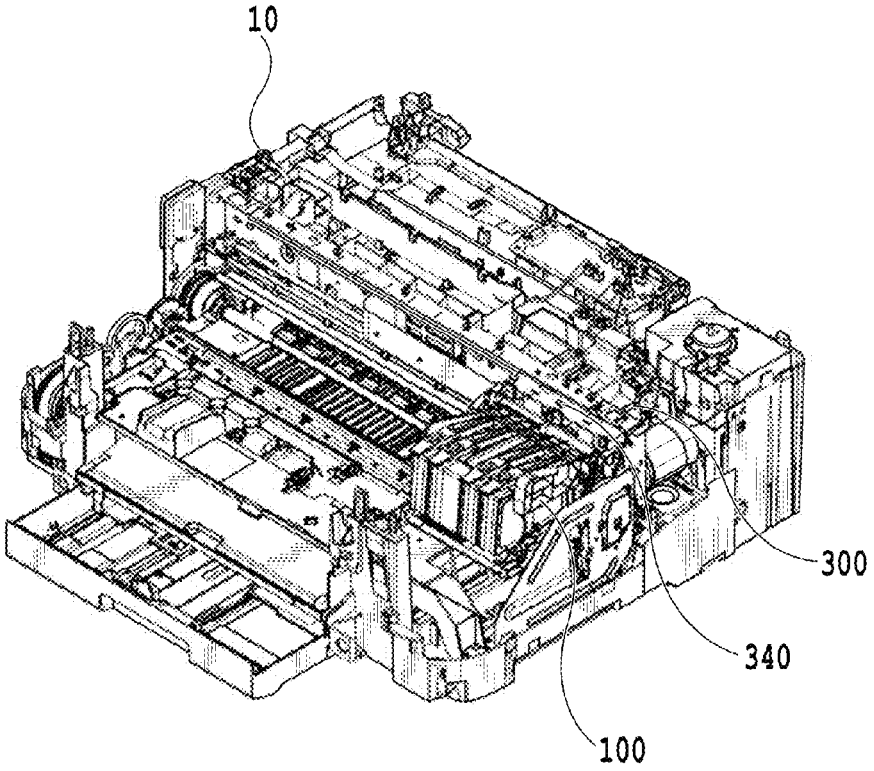
FIG. 1 is a perspective view illustrating an inkjet printing apparatus according to an embodiment of the present invention except for a cover.
Figure 2:
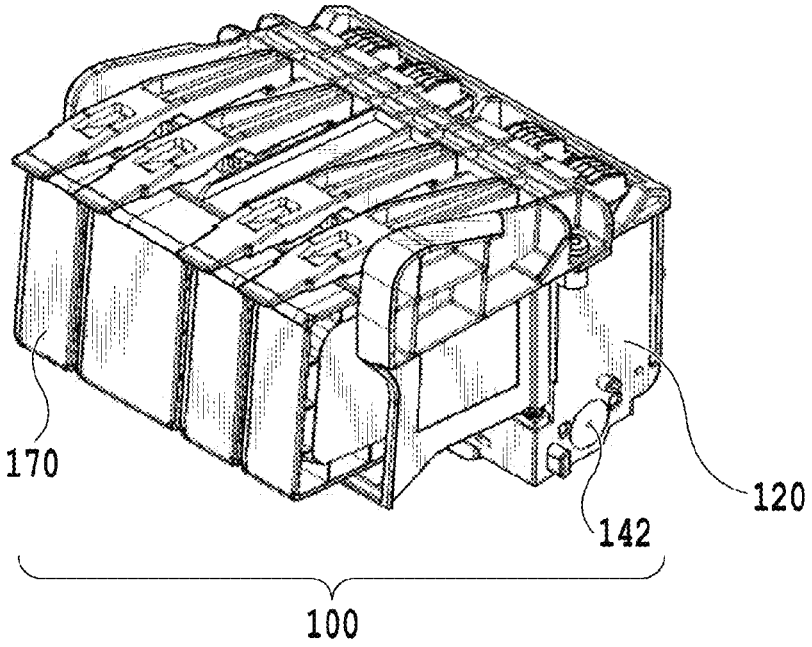
FIG. 2 is a perspective view illustrating the details of the print head unit shown in FIG. 1.
Figure 3:
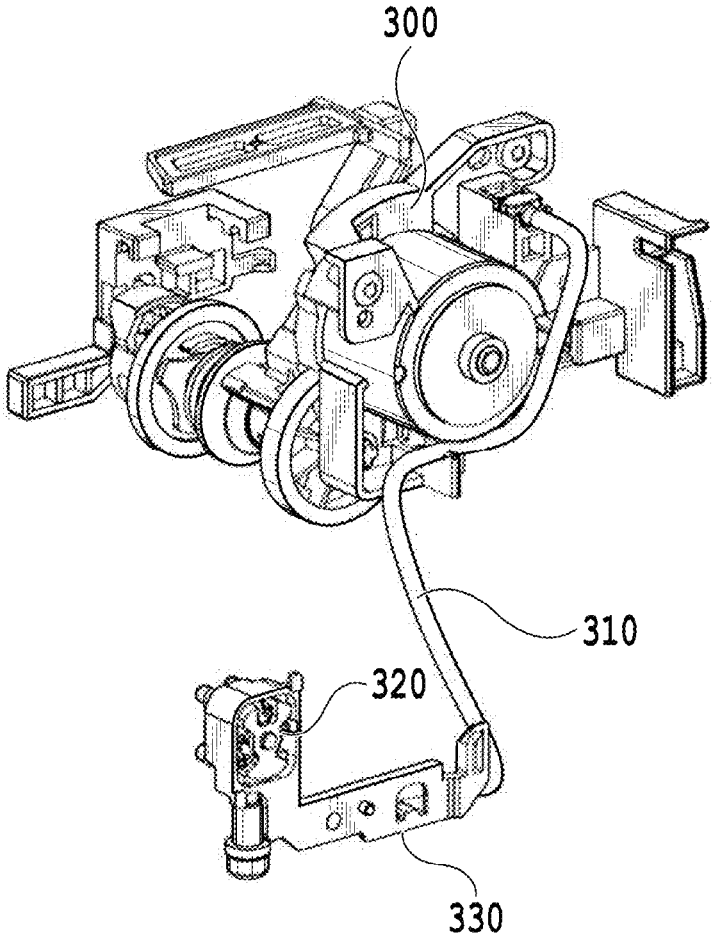
FIG. 3 is a view showing the details of the pump unit shown in FIG. 1.

FIGS. 1 to 3 illustrate the configuration of an inkjet printing apparatus according to one embodiment of the present invention. Specifically, FIG. 1 is a perspective view illustrating the inkjet printing apparatus with a cover being removed. FIG. 2 is a perspective view illustrating the details of the print head unit 100 shown in FIG. 1. FIG. 3 is a view illustrating the details of the pump unit 300 shown in FIG. 1.

In these drawings, an inkjet printing apparatus 10 includes the print head unit 100, a carriage unit 340 that is movable with mounting the print head unit 100, a feeding mechanism for feeding a print medium such as a print paper, and a conveying mechanism for conveying the print medium fed through the feeding mechanism to the printing portion by the printing unit. A pump unit 300 is provided at one end of the movement range of the carriage unit 340. At the bottom face side of the inkjet printing apparatus 10, a paper feed tray is provided. A print medium placed in the paper feed tray is fed through the feeding mechanism.

The print head unit 100 is configured to include a print head (not shown), a sub tank (not shown) for which the details will be described later, and a main tank 170. The main tank 170 is detachably attached to the apparatus. Depending on the ink ejection operation of the print head, ink is supplied from the sub tank to the print head. When the ink amount in the sub tank is lower than a predetermined amount or when the ink in the main tank 170 is caused to be substantially emptied as described later for example, a filling operation is performed to supply ink from the main tank 170 to the sub tank. The print heads, the sub tanks, and the main tanks are prepared for each of the types of inks. In this embodiment, the print heads, the sub tanks, and the main tanks are prepared for each of four colors of inks (i.e., inks of yellow (Y), black (Bk), cyan (C), and magenta (M)). The pump unit 300 is configured to include a tube pump and a motor for driving the rotation of a tube pressing roller for squeezing the tube of the tube pump. The pump unit 300 further includes a guide unit 330 and includes a suction pad 320 for contacted to the decompression opening of the sub tank, and a tube 310 for the communication between the suction pad and the tube pump. This allows the pump unit 300 to perform, when the sub tank is filled with ink from the main tank 170, the suction to decompress the decompression chamber of the sub tank as described later.

Figure 4:
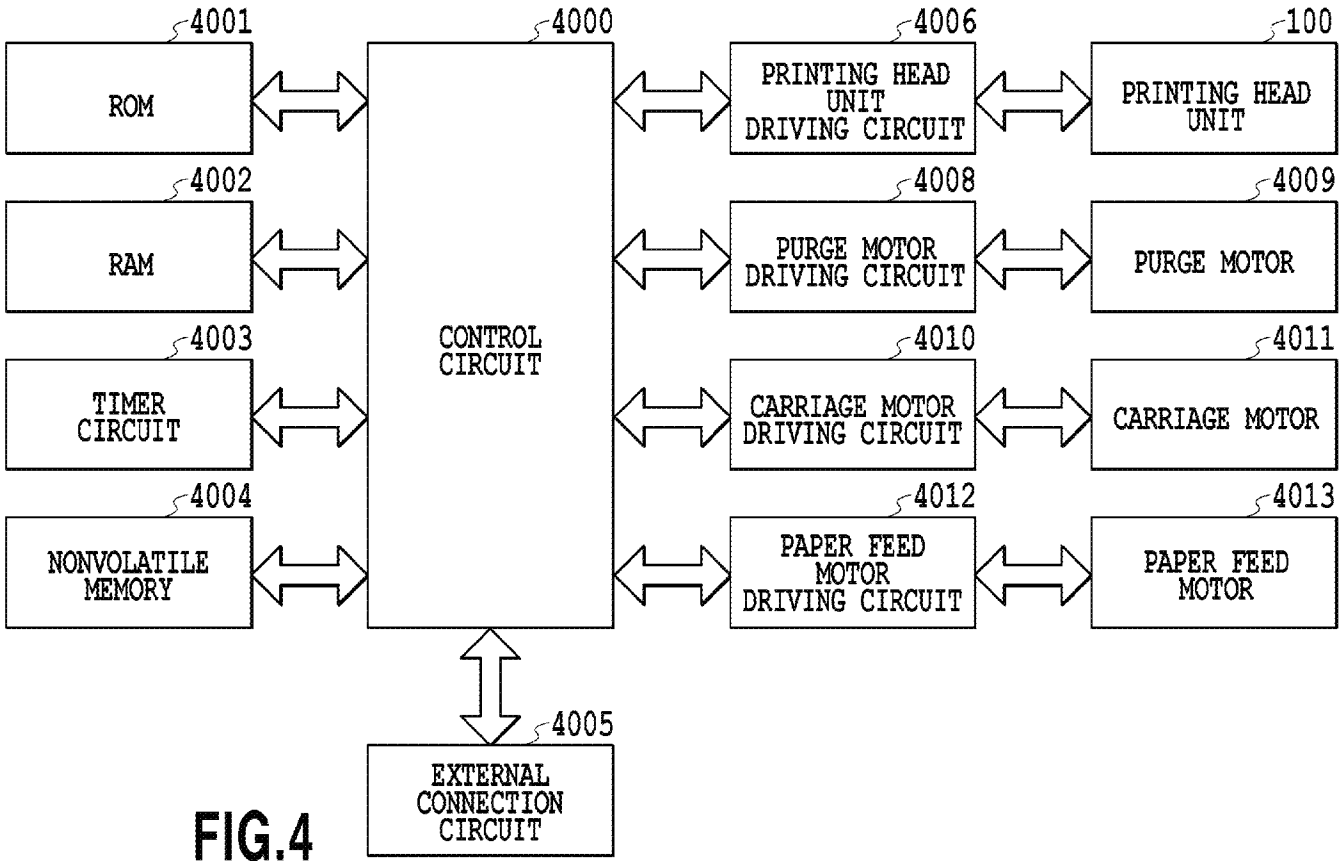
FIG. 4 is a block diagram of the control configuration of the printing apparatus shown in FIG. 1.

FIG. 4 is a block diagram illustrating the control configuration of the printing apparatus shown in FIG. 1. In the drawing, the ROM 4001 stores therein the respective set values in a control program and a control executed in the apparatus of this embodiment. The RAM 4002 temporarily stores data of printing data, a control instruction, and control variables in the respective controls processed when the above control program is executed. A timer circuit 4003 acquires the current time or measures the elapsed time. A nonvolatile memory 4004 is used to written thereto and read therefrom time of certain control timing and stores therein the result of determining whether or the ink filling operation of this embodiment is carried out or not, for example.

The control circuit 4000 executes a control program stored in the above-described ROM 4001 or a control program developed in the RAM 4002. The processing for the ink amount control of the main tank which will be described later is one of the control programs and is executed by the control circuit 4000.

An external connection circuit 4005 is a circuit that can be used by the control circuit 4000 as an interface and a control signal to perform communication between the printing apparatus of this embodiment and an external host apparatus in a wired or wireless manner. Via the external connection circuit 4005, an image data to be printed is inputted. The control circuit 4000 develops this received image data in the RAM 4002. The control circuit 4000 is configured, based on the data on the RAM 4002, to control the driving of the print head unit 100 via the print head unit driving circuit 4006 and to control the driving of the carriage motor 4011 via the carriage motor driving circuit 4010. By the control for the print head unit 100 and the carriage motor 4011, ink is ejected to a desired position on a print medium. The control circuit 4000 can control the conveying motor 4013 via the conveying motor driving circuit 4012 to thereby convey a print medium by a predetermined amount during a printing operation. In an ink filling operation according to one embodiment of the present invention which will be described later, the control circuit 4000 controls, via a purge motor driving circuit 4008, a purge motor 4009 for driving a tube pump.

Figure 5:
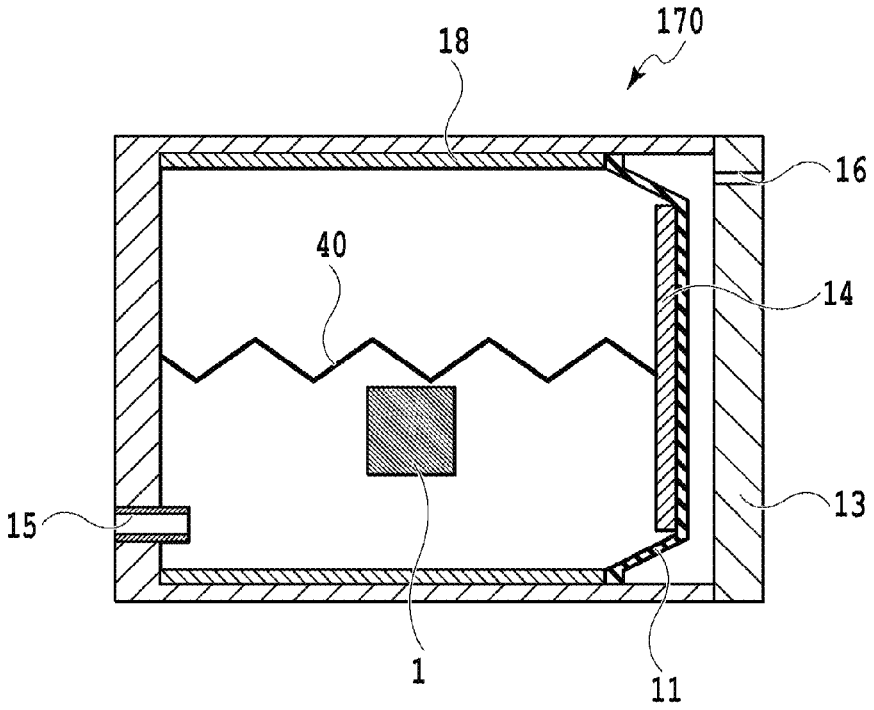
FIG. 5 is a cross-sectional view of the main shown in FIG. 2.

FIG. 5 is a cross-sectional view illustrating the main tank 170 shown in FIG. 2. As shown in FIG. 5, the main tank 170 has a containing portion having an ink containing space formed by a movable member 11, a frame 18, and an outer case 13. The movable member 11 is obtained by molding a deformable and flexible film to have a convex shape. A plane forming the top of the convex shape is attached with a plate 14, thereby allowing the peripheral edge of the top of the convex shape to be deformable. The containing space includes therein a spring 4 one end of which is attached to the plate 14 and the other end of which is fixed to a wall face also functioning as the outer case 13. This allows, when the ink amount is reduced in the containing portion, the movable member 11 to deform such that the negative pressure of the containing space is balanced with the elastic force by the spring 40. The main tank 170 includes, at a part of the outer case thereof, a supply opening for supplying stored ink to the sub tank and an air introduction opening (bubbler) 1 for introducing air from the exterior when a predetermined negative pressure is reached relative to the external air pressure. The air introduction opening 1 includes thereon meniscus so that no gas is introduced until a predetermined negative pressure is reached. This consequently can suppress an increase of a negative pressure in the containing space due to ink consumption, thus preventing a defective ejection.

Figure 6:
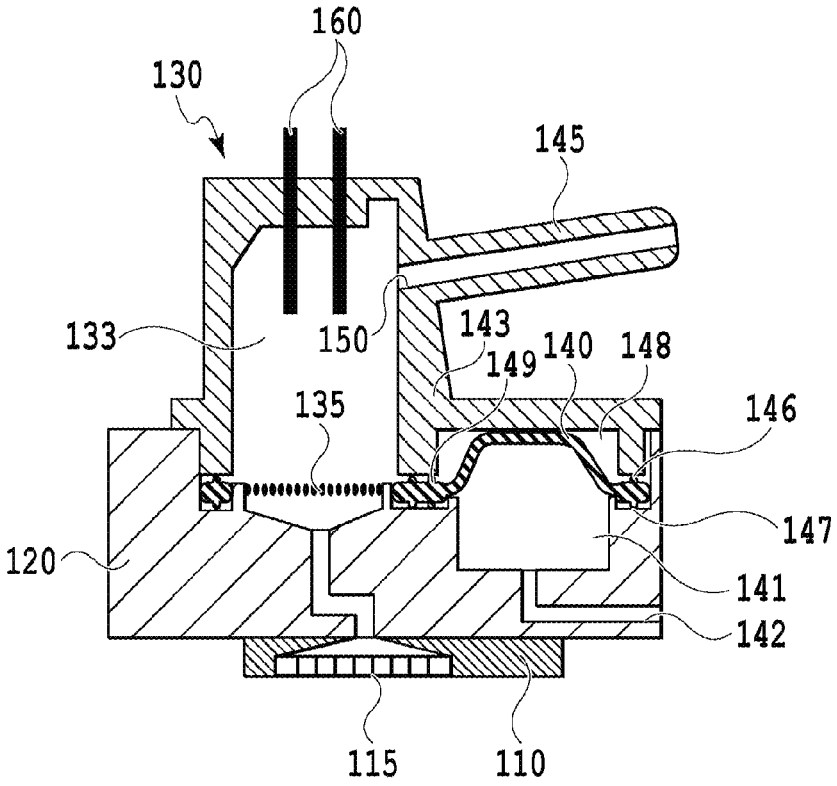
FIG. 6 is a schematic cross-sectional view mainly illustrating the configuration of a sub tank according to this embodiment.

FIG. 6 is a schematic cross-sectional view mainly illustrating the configuration of the sub tank 130 according to the embodiment. The lower part of the sub tank 130 is connected to the print head 110. Specifically, the print head 110 includes a liquid chamber 115 having an ejection heater for each ink ejection opening and is attached to the lower side of the tank retaining member 120 in which the sub tank 130 is formed. An ink supply opening commonly provided for the plurality of liquid chambers 115 of the print head 110 communicates with the filter 135 (joint chamber 133) of the sub tank 130 via an ink path formed in the tank retaining member 120. The tank retaining member 120 has a decompression chamber 141 communicating with the tube pump of the pump unit 300 via the decompression opening 142. The decompression chamber 141 includes a flexible member 140 that can be deformed depending on the pressure of the decompression chamber 141. One side of the flexible member 140 is fixed between the tank retaining member 120 and the sub tank forming member 143 via seal members 146 and 147. This consequently seals the decompression chamber 141 and the ink chamber 148 from the exterior of the sub tank 130. The other end side of the flexible member 140 is configured so that the ink chamber 148 communicates with the joint chamber 133 by providing the flexible member 140 between the sub tank forming member 143 and tank retaining member 120 via a plurality of spacers having an interval thereamong, thereby forming the communication part 149. As will be detailed later, by the displacement of the flexible member 140 in the decompression chamber 141, an ink filling operation of ink from the main tank 170 to the sub tank 130 can be performed.

The joint chamber 133 of the sub tank 130 at the upper side of the tank retaining member 120 has a pair of electrode pins 160. This provides, depending on whether the ink liquid level is higher or lower than the tip of the pin, the determination as to whether the ink amount in the sub tank is lower than a predetermined amount or not. Specifically, if a pair of electrode pins 160 have therebetween a voltage V1 higher than a threshold value A, the ink liquid level of the sub tank 130 (the joint chamber 133) is lower than the tip end of the electrode pin 160, thus detecting that the ink amount is smaller than a predetermined amount. The joint chamber 133 of the sub tank 130 includes a not shown ink path formation member (shown by the reference numeral "137" in FIG. 9 for example) which forms an ink path for an ink filling operation described later. Furthermore, the joint chamber 133 of the sub tank 130 includes a supply pipe 145 having an inflow opening 150 at the predetermined height. One side of this supply pipe 145 can be engaged with the supply opening 15 of the main tank 170. This allows the ink in the main tank 170 to be moved into the sub tank 130 via the inflow opening at the tip end of the supply pipe 145. In a normal printing operation, the ink in the joint chamber 133 of the sub tank 130 is reduced depending on the ink ejection operation of the print head 110. A change of the water head depending on this decrease is used to supply the ink from the main tank 170 to the sub tank 130 via the supply pipe 145 and the supply opening 15.

Figure 7:
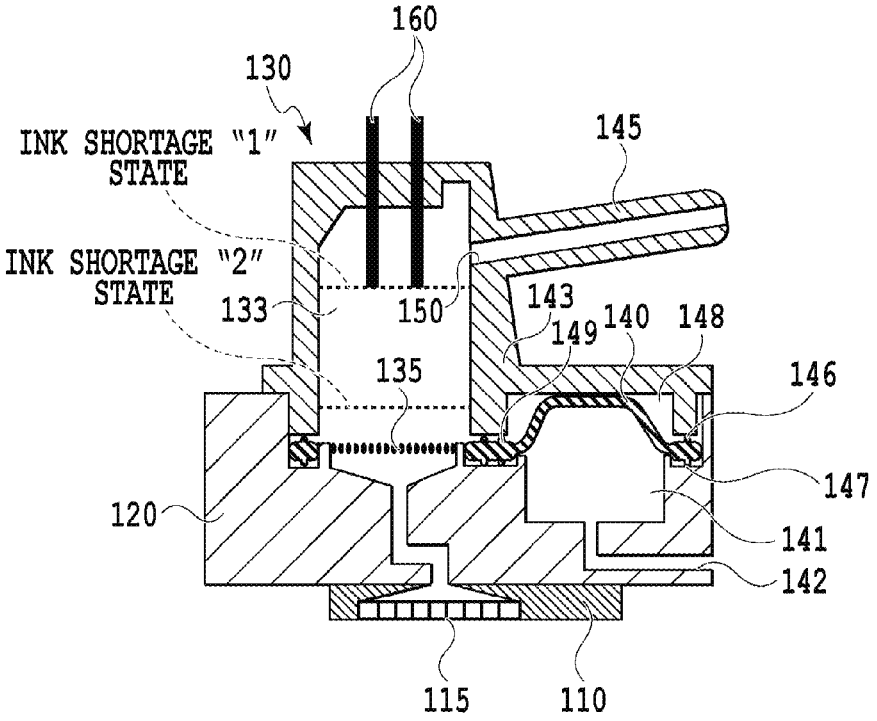
FIG. 7 illustrating a state in which two ink amounts are low in a sub tank in one embodiment of the present invention.

FIG. 7 is a view illustrating two states in each of which ink amounts are low in the sub tank, in one embodiment of the present invention. When the remaining ink amount in the main tank 170 is equal to or lower than the predetermined amount, the relation with the water head causes a substantial stoppage of the ink supply to the sub tank 130. Even in such a case, ink existing in the joint chamber 133 of the sub tank 130 can be used for printing. Thus, when a printing operation is performed, ink consumption causes a lower ink liquid level in the sub tank 130. The lower ink liquid level causes a higher voltage V between the electrode pins 160. Thus, depending on whether a threshold value set in advance is exceeded or not, whether the ink amount is smaller than the predetermined amount or not can be determined. The state as shown in FIG. 7 will be referred to as a "first ink shortage (ink shortage "1") state" in which the liquid level is lower than the electrode pins 160 and the voltage V between the electrodes is higher than the predetermined threshold value. If a printing operation is continued after the ink amount is in the first ink shortage state, the ink liquid level in the joint chamber 133 of the sub tank 130 decreases and finally the ink amount available for a printing operation is insufficient, thus causing a blurred printed image or the like. In this embodiment, after the first ink shortage state, the sub tank ink consumption amount after the first ink shortage state is measured by an ink consumption amount count unit that counts the number of ejections through each nozzle to calculate the total, for each ink color. As shown in FIG. 7, a state in which the ink consumption amount in the sub tank exceeds the predetermined value will be referred to as a "second ink shortage (ink shortage "2") state". When this second ink shortage state is reached, a printing operation is stopped to prevent a blurred image or the like from being caused. In this embodiment, a predetermined amount causing the second ink shortage state is 1000 mg at which the ink liquid level in the sub tank is lowered to the neighborhood of the filter 135.

Figure 8A:
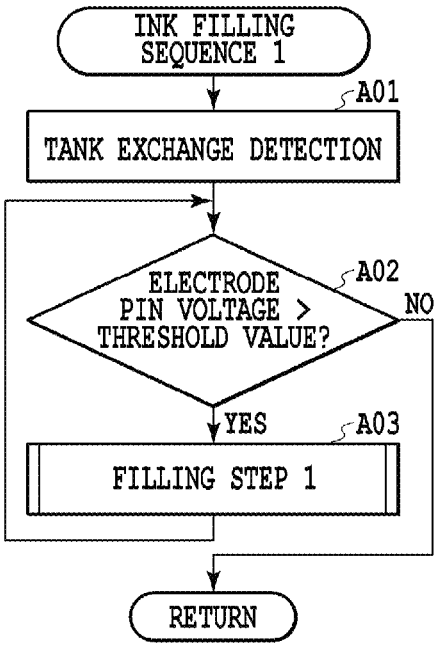
FIG. 8A is a flowchart illustrating an ink filling operation performed after the exchange of the main tank according to one embodiment of the present invention.
Figure 8B:
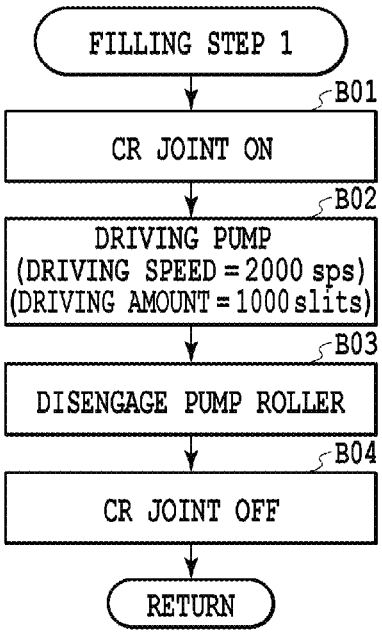
FIG. 8B is a flowchart illustrating the details of a filling step in the ink filling operation shown in FIG. 8A.

FIG. 8A is a flowchart illustrating ink filling operation (also may be referred to as "first ink filling sequence") performed after the exchange of a main tank, according to one embodiment of the present invention. FIG. 8B is a flowchart illustrating the details of a filling step (also may be referred to as "first filling step" (filling step "1")) in the ink filling operation shown in FIG. 8A. This ink filling operation is a processing executed when an ink tank is exchanged after the sub tank 130 is in the first ink shortage state or the second ink shortage state. This processing is used to fill the sub tank with ink to achieve an ink liquid level equal to or higher than the electrode pins 160.

In FIG. 8A, first, when the tank exchange is detected (A01), it is determined whether the voltage between the electrode pins 160 is higher than a predetermined threshold value or not i.e., whether the ink liquid level of the joint chamber 133 of the sub tank reaches the tip end of the electrode pins 160 or not (A02). When the ink liquid level does not reach the tip end of the electrode pins 160, then the first filling step (filling step 1) is performed in Step A03.

Figure 9A:
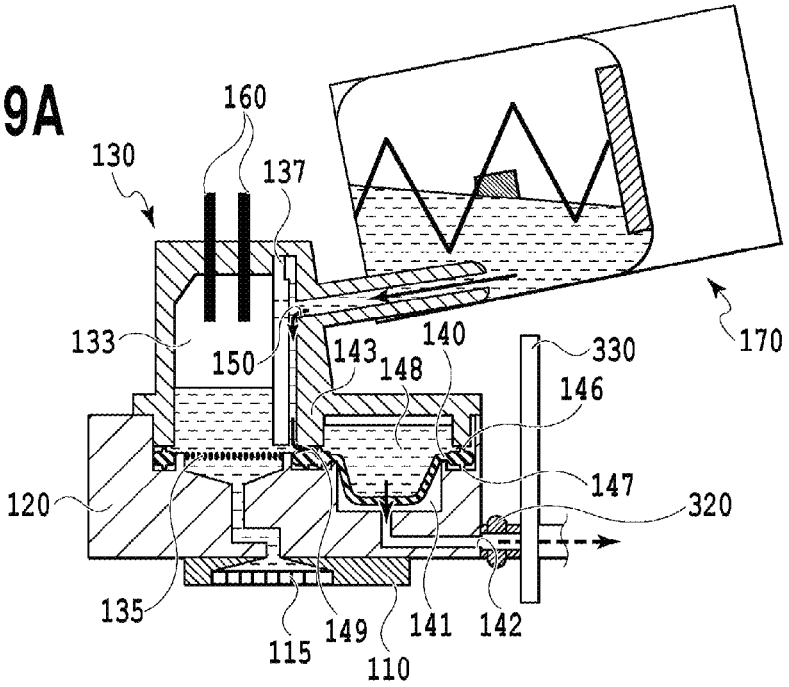
FIGS. 9A and 9B are views illustrating the movement of ink for example in a filling step 1 to a sub tank according to one embodiment of the present invention.
Figure 9B:
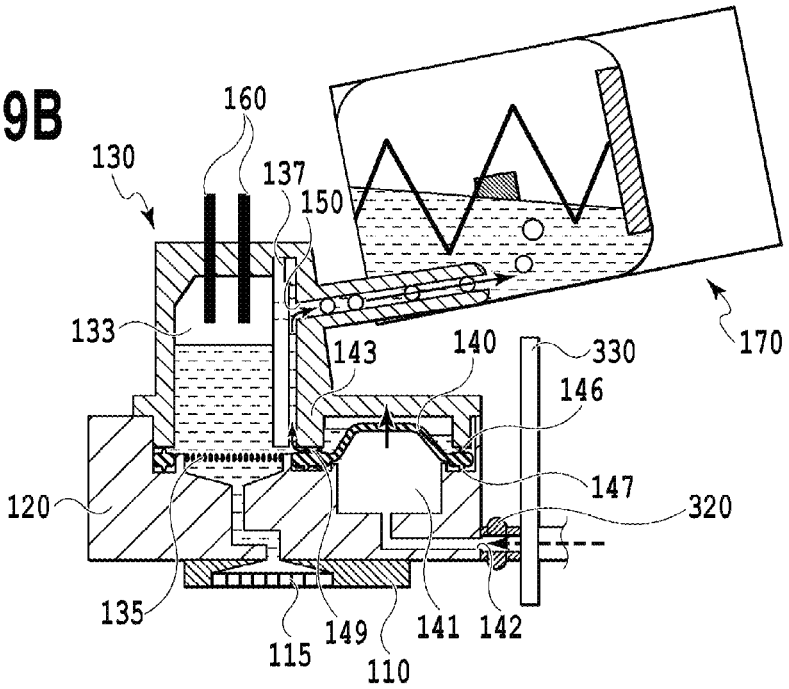

FIG. 8B illustrates the details of the first filling step of Step A03 as described above. FIGS. 9A and 9B mainly illustrate the movement of ink or the like in the first filling step.

First, in Step B01, the carriage 340 is moved to one end of the inkjet printing apparatus 10 (a position shown in FIG. 1). This causes the suction pad 320 connected to the guide unit 330 to be contacted with the decompression opening 142 in the tank retaining member 120 for retaining the sub tank 130. Next, in Step B02, the tube pump is driven at predetermined drive speed and driving amount (2000 slits per second, 10000 slits) to thereby reduce pressure in the decompression chamber 141 of the sub tank. As a result, the flexible member 140 is deformed as shown in FIG. 9A so as to be moved to the decompression chamber side. This causes the ink in the main tank 170 to be introduced to the ink chamber 148 through the above-described ink path of the ink path formation member 137.

Next, in Step B03, the squeezing pressure by the roller of the tube pump is released to thereby allow the decompression chamber 141 to communicate with air. This causes, as shown in FIG. 9B, the flexible member 140 to move toward the ink chamber 148. This movement causes the ink in the ink chamber 148 to move through both of the ink path of the ink path formation member 137 and the communication part 149 communicating with the joint chamber 133 to reach the respective parts. The ink path of the ink path formation member 137 is configured to have a higher resistance than that of the communication part 149. Thus, the above movement of the flexible member 140 causes more ink to be moved to the joint chamber 133 and the joint chamber 133 is filled with ink. During this movement, the ink liquid level upwardly moves mainly in the joint chamber 133 to thereby change the air in the joint chamber 133 into bubbles via the supply pipe 145 and the bubbles are discharged to the main tank. Then, in Step B04, the carriage 340 is moved to the original position.

This first filling step can be repeated until the voltage between the electrode pins 160 is equal to or lower than the threshold value i.e., until the ink liquid level in the joint chamber 133 is higher than the tip of the electrode pins 160 to thereby supply ink in the main tank to the sub tank. Thus, bubbles remaining in the sub tank can be returned to the main tank and the ink liquid level in the sub tank can be increased.

Figure 10:
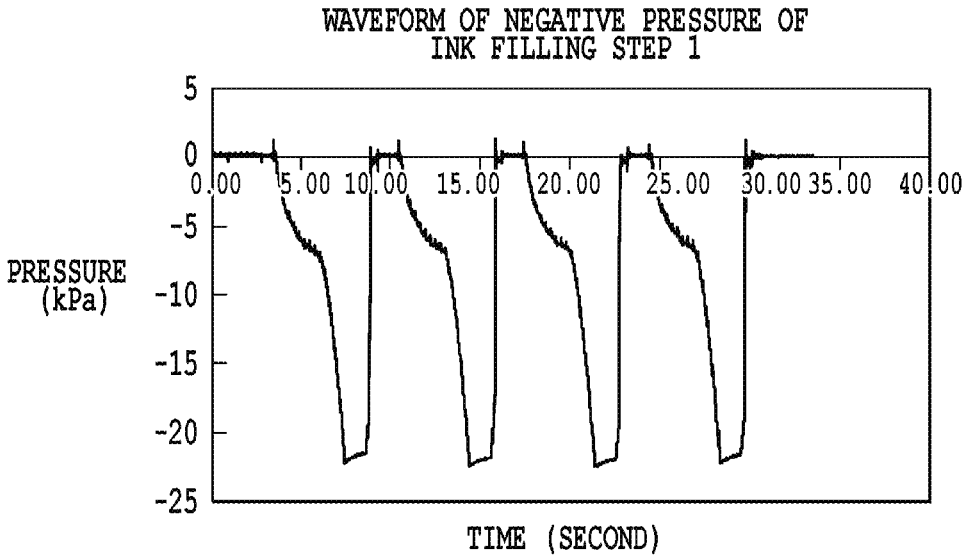
FIG. 10 is a graph illustrating a pressure change in a decompression chamber of a sub tank in the filling step 1 described in FIG. 9.

FIG. 10 is a graph illustrating a pressure change in the decompression chamber 141 of the sub tank in the above-described first filling step. In the example shown in FIG. 10, the first filling step is performed four times.

As described above, the exchange of the main tank for example is followed by the ink filling operation to the sub tank 130. Thereafter, in accordance with a printing operation, ink is continuously supplied from the main tank 170 to the sub tank 130, thus reducing the amount of ink remaining in the main tank 170. Then, when the amount of ink remaining in the main tank 170 is equal to or lower than a predetermined amount, then the ink supply from the main tank to the sub tank is stopped as described above. In this state, ink supplied from the main tank to the sub tank is gradually reduced and the ink flow in the supply path is narrower. Finally, a phenomenon is caused in which the meniscus in the ink supply path is broken in the vicinity of the range from the supply opening 15 of the main tank to the inflow opening of the sub tank, thereby stopping the ink supply to the sub tank.

Figure 11:
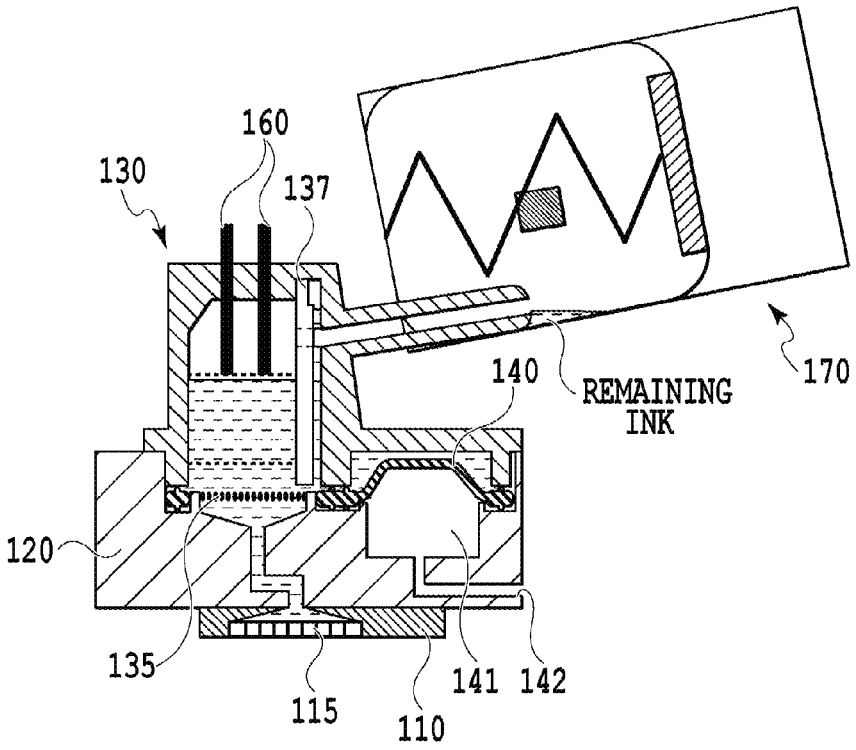
FIG. 11 is a view illustrating the ink states of a main tank and a sub tank according to one embodiment of the present invention when the ink supply from the main tank to the sub tank is stopped.

FIG. 11 is a view illustrating the ink state in the main tank and sub tank in this state. As shown in FIG. 11, since there is no more ink flow in the ink supply path to the sub tank 130, a minute amount of ink remaining in the main tank 170 cannot be used for a subsequent printing operation and thus remains in the main tank. When no more ink is supplied from the main tank 170, the sub tank 130 becomes a state in which the ink liquid level in the joint chamber 133 is equal to or lower than the tip end of the electrode pin 160, i.e. is in the first ink shortage state.

The main tank of this embodiment has a configuration in which no valve is provided in the supply opening 15 (FIG. 5). Thus, when the supply opening 15 of the main tank communicates with air during a the exchange of the main tank for example, external air flows into the tank and a negative pressure cannot be maintained any more. This causes a risk where ink remaining in the main tank is leaked through the supply opening 15. To prevent this, according to one embodiment of the present invention, the second ink filling operation is performed to move a minute amount of remaining ink in the main tank 170 to the sub tank 130. As a result, the ink remaining in the main tank can be supplied to the sub tank and is available, thus improving the efficiency of ink of the ink tank.

Figure 12A:
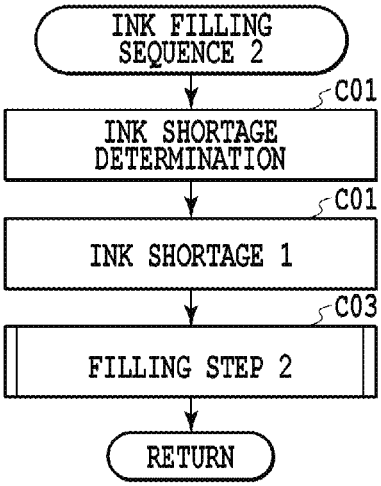
FIG. 12A is a flowchart illustrating the second ink filling operation according to the first embodiment of the present invention.
Figure 12B:
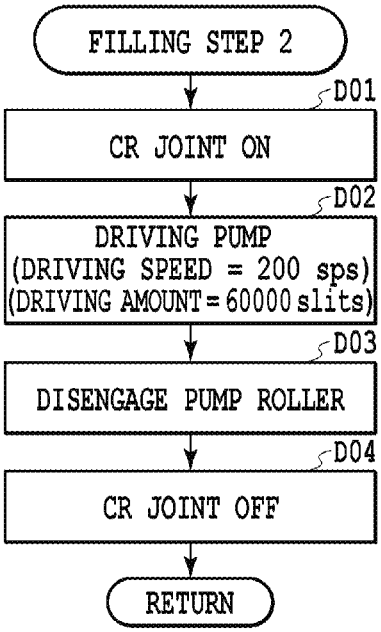
FIG. 12B is a flowchart illustrating the details of a filling step in the ink filling operation shown in FIG. 12A.

FIG. 12A is a flowchart illustrating the second ink filling operation (also may be referred to as a "second ink filling sequence") according to the first embodiment of the present invention. FIG. 12B is a flowchart illustrating the details of a filling step (also may be referred to as a "second filling step" (filling step "2")) in the ink filling operation shown in FIG. 12A.

When a printing operation is performed after the ink remaining in the main tank is in the state shown in FIG. 11, ink supplied to the sub tank is decreased and then no ink is supplied to the sub tank, and thus the ink liquid level in the sub tank decreases and is in the first ink shortage state. In response to this, as shown in FIG. 12A, first in Step C01, a voltage between the electrode pins exceeding a threshold value is firstly detected. Then, the first ink shortage state is determined (C02) and the second filling step is performed (C03; filling step "2").

In this second filling step, as shown in FIG. 12B, first, in Step D01, as in Step B01 of the above-described first filling step, the carriage 340 is moved to the right end side of the inkjet printing apparatus 10. As a result, the suction pad 320 connected to the guide unit 330 is contacted to the decompression opening 142 of the ink tank unit 120.

Figure 13:
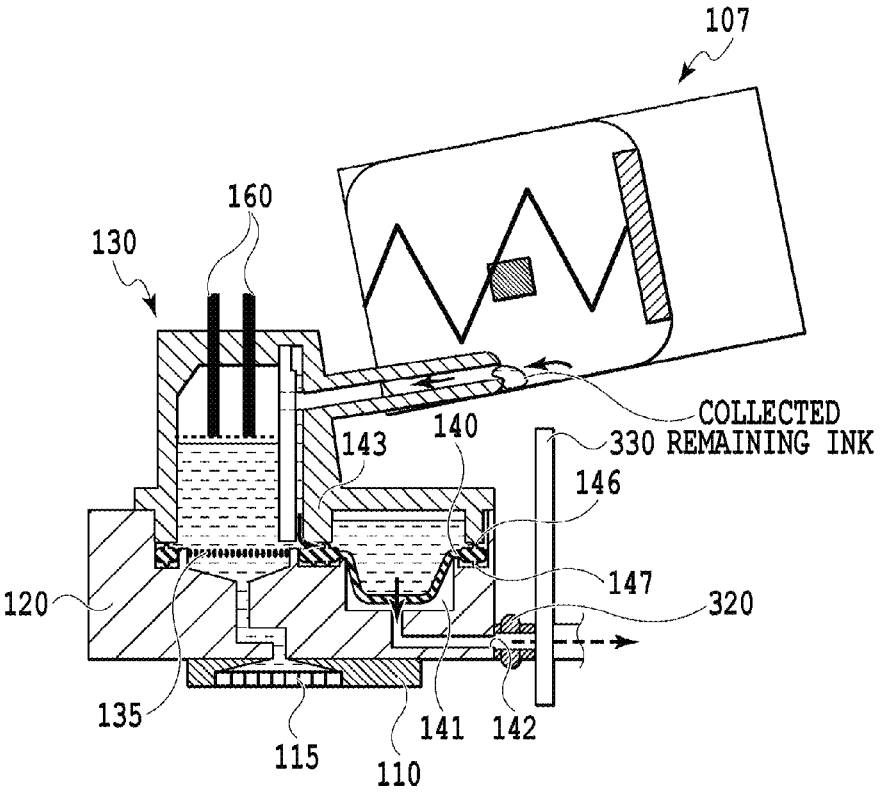
FIG. 13 is a view illustrating how the filling step 3 shown in FIG. 12 to use to gradually collect ink around an ink supply opening for a minute amount in a main tank so that ink flows into a sub tank.

Next, in Step D02, the pump is driven at predetermined drive speed and driving amount, thereby decompressing the decompression chamber 141 in the sub tank. In this embodiment, the drive speed is 200 slits per second and the driving amount is 60000 slits. This is a driving amount lower than the drive speed of 2000 slits per second in the first ink filling step and is greater than the driving amount of 10000 slits. Thus, a negative pressure generated in the decompression chamber 141 causes a slow change of volume by displacement of the flexible member 140 when compared with the case of the first filling step. As a result, as shown in FIG. 13, a minute amount of ink in the main tank 170 is gradually collected around the supply opening 15 and is then discharged into the joint chamber 133 of the sub tank 130.

The processing of Steps D03 and D04 are similar to those of Steps B03 and B04 of the first filling step.

Figure 14:
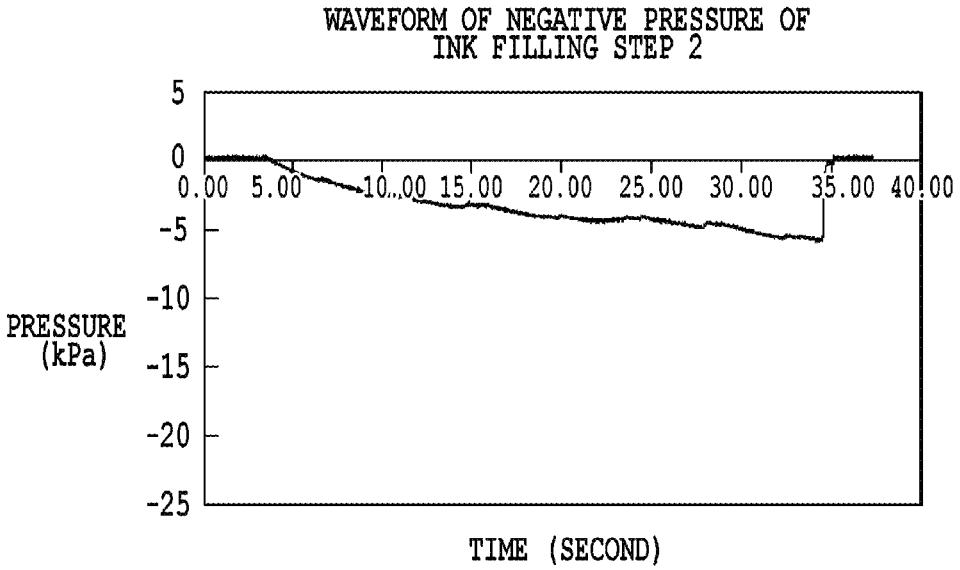
FIG. 14 is a graph showing a pressure change in the decompression chamber of the sub tank in the second filling step shown in FIG. 12.

FIG. 14 is a graph illustrating a pressure change in the decompression chamber 141 of the sub tank in the above-described second ink filling step. As shown in FIG. 14, a pump driving at a low speed for a long time is used to generate a negative pressure having a relatively small value for a long time. The driving at a low speed allows ink to be efficiently collected without breaking the meniscus of the remaining ink. Furthermore, the driving for a long time can provide the collection of ink and the time required for ink to flow into the sub tank. When ink of a predetermined amount or more remains in the main tank prior to the determination that ink shortage exists based on an electrode pin voltage, a control is performed in a normal operation to prevent the tank from being movable to a tank exchange position so that a user is prevented from carelessly removing the tank.

In this embodiment, as shown in FIG. 15, the remaining ink amount in the main tank having a possibility of the stoppage of the ink supply from the main tank to the sub tank is 1.0 g at maximum and the remaining ink amount in the main tank having a possibility of ink leakage is 0.8 g at minimum and is reduced at least to 0.6 g by performing the second ink filling step (an ink discharge operation from the main tank). Thus, when the second filling step is not performed, a possibility of ink leakage is caused during the exchange of the main tank. However, the execution of the second ink filling step can reduce the possibility of ink leakage.

Second Embodiment

In the first embodiment, the second filling step is performed in the first ink shortage state after the determination of ink shortage. However, the possibility of ink leakage during the removal of the main tank can be reduced by performing the second filling step during a period from the determination of ink shortage to the removal of the main tank. Thus, the timing at which the second filling step is executed is not limited to timing just after the first ink shortage state is entered. For example, the second filling step may be executed after a predetermined amount of ink is consumed after the first ink shortage state or after the second ink shortage state or at a timing during the exchange of the main tank or during a standby state in which no printing is performed.

Figure 16A:
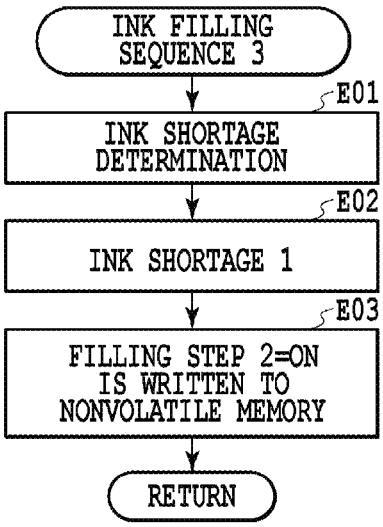
FIGS. 16A and 16B are a flowchart illustrating an ink filling operation according to the second embodiment of the present invention.
Figure 16B:
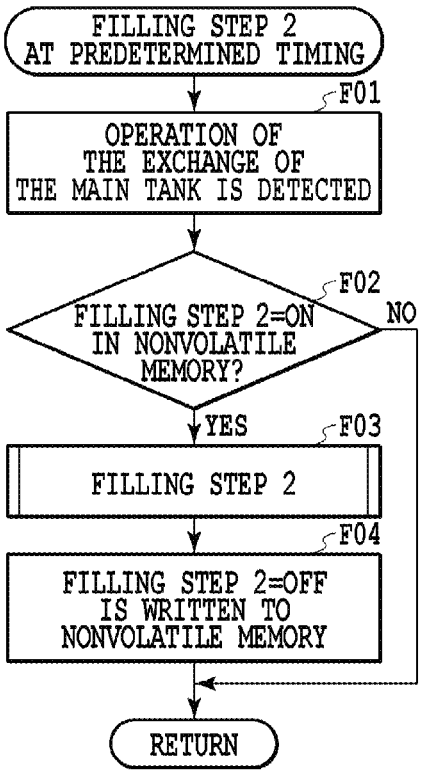

FIGS. 16A and 16B are flowcharts illustrating an ink filling operation according to the second embodiment of the present invention (also may be referred to as a "third ink filling sequence"). In this embodiment, the second filling step is performed during the exchange of the main tank.

In FIG. 16A, when the voltage between the electrode pins 160 exceeds the threshold value and ink shortage is determined (E01), then the first ink shortage state is determined (E02). Thus, it is determined that the second filling step must be performed and the second filling step=ON is stored in a nonvolatile memory 4004. Thereafter, as shown in FIG. 16B, when the exchange of the main tank is detected (F01), then the information for the second ink filling step is read from the nonvolatile memory 4004 (F02). When the second ink filling step=ON is established, the second ink filling step is performed (F03). In Step F04, the second ink filling step=OFF is written to the nonvolatile memory. Information showing whether the second filling step is required or not may be firstly stored in the RAM 4002 and may be stored in the nonvolatile memory 4004 when the power source is cut off.

Third Embodiment

When the amount of ink remaining in the main tank 170 is equal to or lower than a predetermined amount, ink supplied from the main tank to the sub tank is gradually insufficient as described above, thus causing the ink flowing in the ink supply path to be narrower. As a result, the meniscus of the ink supply path is broken in the vicinity of a range from the supply opening 15 of the main tank to the inflow opening of the sub tank. This breaking of the meniscus is caused at an earlier timing in accordance with an increase of the supply flow rate. This consequently causes the ink remaining in the main tank to increase than in a normal case. This is caused by the fact that an increase of the supply flow rate causes a proportional increase of the ink flow resistance. A low temperature environment or a high ink viscosity due to evaporation for example also causes a similar tendency because of the increase of the ink flow resistance. A case where the supply flow rate is high includes, for example, a case where printing data is data that causes many ink dots to be ejected through a print head or a case where a maintenance operation of the print head is performed by performing a suction recovery operation at a high ink discharge speed. In this embodiment, the filling step are differentiated depending on whether the suction recovery operation is performed or not.

Figure 17B:
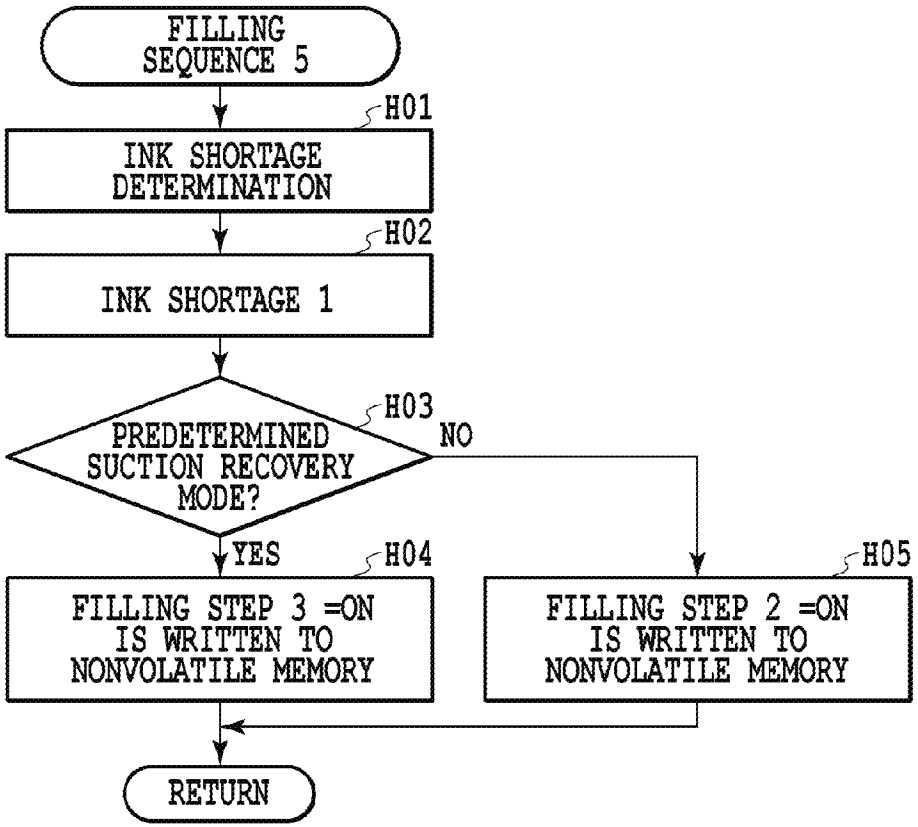
FIGS. 17A and 17B are a flowchart illustrating the ink filling operation according to the third embodiment of the present invention.
Figure 17A:
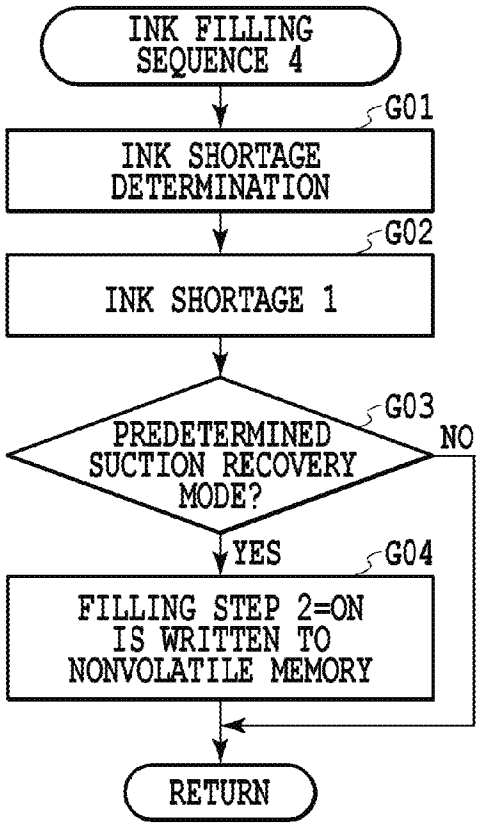

FIGS. 17A and 17B are a flowchart illustrating the ink filling operation according to the third embodiment of the present invention.

FIG. 17A illustrates an embodiment to determine whether the second filling step is required or not based on whether the executed suction recovery operation is in a predetermined suction recovery mode, when the ink remaining in the main tank is equal to or lower than a predetermined value. The predetermined suction recovery mode is set in advance based on the ink discharge amount and the ink discharge speed. In addition to the suction recovery mode, the environment temperature, the environment humidity or the ink type may be added to determination conditions. As shown in FIG. 17B, the third filling step (filling step "3") having a driving amount (driving time) further longer than that of the second filling step is prepared. When the executed suction recovery operation is in the predetermined suction recovery mode, the third filling step is selected to be carried out. The third filling step may be a step having a drive speed higher than that of the second filling step or having the second filling step performed a plurality of times.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-170346, filed Aug. 25, 2014, which is hereby incorporated by reference wherein in its entirety.

What is claimed is:

1. A printing apparatus comprising:

a print head for ejecting ink;

a moveable carriage on which the print head is mounted for movement with the carriage;

a sub tank mounted on the carriage and which stores ink supplied to the print head;

a main tank removably mounted on the carriage and which stores ink supplied to sub tank;

a detection unit configured to detect an ink amount in the sub tank;

an ink filling unit configured to perform an ink supply operation in which a pump is driven for supplying ink from the main tank to the sub tank; and a control unit configured to cause the ink filling unit to perform a first ink supply operation in which the pump is driven for a first driving time when the main tank is mounted on the carriage, and to cause the ink filling unit to perform a second ink supply operation in which the pump is driven for a second driving time longer than the first driving time in a case where the detection unit detects that the ink amount is smaller than a predetermined amount.

2. The printing apparatus according to claim 1, wherein the control unit is further configured to cause the ink filling unit to perform the second ink supply operation in which the driving unit is driven at a lower drive speed than that in the first ink supply operation.

3. The printing apparatus according to claim 1, wherein the control unit is further configured to cause the ink filling unit to perform the second ink supply operation after the detection unit detects the ink amount less than the predetermined amount.

4. The printing apparatus according to claim 1, wherein the control unit is further configured to cause the ink filling unit to perform the second ink supply operation after the detection unit detects the ink amount less than the predetermined amount and thereafter a second predetermined amount of ink in the sub tank has been consumed.

5. The printing apparatus according to claim 1, wherein the control unit is further configured to cause the ink filling unit to perform the second ink supply operation after the detection unit detects the ink amount less than the predetermined amount and thereafter when the detection unit detects the ink amount less than a second predetermined amount that is less than the predetermined amount.

6. The printing apparatus according to claim 1, wherein the control unit is further configured to cause the ink filling unit to perform the second ink supply operation after the detection unit detects the ink amount less than the predetermined amount and thereafter when the main tank is detached from the carriage.

7. The printing apparatus according to claim 1, wherein the control unit determines whether to cause the ink filling unit to perform the second ink supply operation based on at least one of an ink supply amount, a type of ink, environmental temperature and environmental humidity at time when an ink remaining amount in the main tank is less than the predetermined amount, and the second ink supply operation is performed according to a result of the determination.

8. An ink filling method in an ink jet apparatus that includes a print head for ejecting ink, a movable carriage on which the print head is mounted for movement with the carriage, a sub tank mounted on the carriage and which stores ink supplied to the print head, and a main tank removably mounted on the carriage and which stores ink supplied to sub tank, the method comprising:

a first ink supply step in which a pump is driven for a first driving time for supplying ink from the main tank to the sub tank when the main tank is mounted on the carriage; and a second ink supply step in which the pump is driven for a second driving time longer than the first driving time for supplying ink from the main tank to the sub tank in a case where an ink amount in the sub tank is detected to be smaller than a predetermined amount.

9. A printing apparatus comprising:

a print head for ejecting ink;

a movable carriage on which the print head is mounted for movement with the carriage;

a sub tank mounted on the carriage and which stores ink supplied to the print head;

a main tank removably mounted on the carriage and which stores ink supplied to the sub tank;

a detection unit configured to detect an ink amount in the sub tank;

an ink filling unit configured to perform an ink supply operation in which a pump is driven for supplying ink from the main tank to the sub tank; and a control unit configured to cause the ink filling unit to perform a first ink supply operation when the main tank is mounted on the carriage, and to cause the ink filling unit to perform a second ink supply operation in a case where the detection unit detects that the ink amount is smaller than a predetermined amount.

10. The printing apparatus according to claim 9, wherein a driving time for which the pump is driven in the second ink supply operation is longer than a driving time for which the pump is driven in the first ink supply operation.

11. The printing apparatus according to claim 9, wherein a driving speed at which the pump is driven in the second ink supply operation is lower than a driving speed at which the pump is driven in the first ink supply operation.

12. A printing apparatus comprising:

a print head for ejecting ink;

a first storage portion which stores ink supplied to the print head;

a second storage portion which stores ink supplied to the first storage portion and is detachably mounted on the printing apparatus;

a detection unit configured to detect an ink amount in the first storage portion;

an ink filling unit configured to perform an ink supply operation to supply ink from the second storage portion to the first storage portion; and a control unit configured to cause the ink filling unit to perform a first ink supply operation when the second storage portion is attached to the printing apparatus, and to cause the ink filling unit to perform a second ink supply operation that is different from the first ink supply operation in a case where the detection unit detects that the ink amount is smaller than a predetermined amount.

13. The printing apparatus according to claim 12, further comprising a carriage on which the first storage portion is mounted, and the second storage portion is detachably mounted on the carriage.

14. The printing apparatus according to claim 12, wherein the ink filling unit:

performs a first pressure reduction operation for reducing a pressure in the first storage portion and a first relieving operation for relieving the reduced pressure after the first pressure reduction operation, in the first ink supply operation, and performs a second pressure reduction operation for reducing a pressure in the first storage portion and a second relieving operation for relieving the reduced pressure after the second pressure reduction operation, in the second ink supply operation.

15. The printing apparatus according to claim 14, wherein in the first ink supply operation, a repetition of the first pressure reduction operation and the first relieving operation is performed a plurality of times.

16. The printing apparatus according to claim 14, wherein the ink filling unit including a pump for reducing the pressure in the first storage portion and a motor for driving the pump, and wherein a driving time for which the motor drives the pump for the second pressure reduction operation is longer than a driving time for which the motor drives the pump for the first pressure reduction operation.

17. The printing apparatus according to claim 14, wherein the ink filling unit including a pump for reducing the pressure in the first storage portion and a motor for driving the pump, and wherein a driving speed at which the motor drives the pump for the second pressure reduction operation is lower than a driving speed at which the motor drives the pump for the first pressure reduction operation.

18. A printing apparatus comprising:

a print head for ejecting ink;

a first storage portion which stores ink supplied to the print head;

a second storage portion which stores ink supplied to the first storage portion and is detachably mounted on the printing apparatus;

a detection unit configured to detect an ink amount in the first storage portion;

an ink filling unit, including a pump for reducing the pressure in the first storage portion, a motor for driving the pump and a relieving unit configure to relieve a reduced pressure in the first storage portion, configured to perform an ink supplying operation to supply ink from the second storage portion to the first storage portion; and a control unit configured to cause the ink filling unit to perform a first ink supply operation in which a first pressure reduction operation for reducing a pressure in the first storage portion and a first relieving operation for relieving the reduced pressure after the first pressure reduction operation are performed when the second storage portion is attached to the printing apparatus, and to cause the ink filling unit to perform a second ink supply operation in which a second pressure reduction operation for reducing a pressure in the first storage portion and a second relieving operation for relieving the reduced pressure after the second pressure reduction operation are performed in a case where the detection unit detects that the ink amount is smaller than a predetermined amount, wherein a driving time for which the motor drives the pump for the second pressure reduction operation is longer than a driving time for which the motor drives the pump for the first pressure reduction operation.

19. The printing apparatus according to claim 18, wherein a driving speed at which the motor drives the pump for the second pressure reduction operation is lower than a driving speed at which the motor drives the pump for the first pressure reduction operation.

20. The printing apparatus according to claim 18, wherein in the first ink supply operation, a repetition of the first pressure reduction operation and the first relieving operation is performed a plurality of times.

21. The printing apparatus according to claim 18, further comprising a carriage on which the first storage portion is mounted, and the second storage portion is detachably mounted on the carriage.

22. The printing apparatus according to claim 18, wherein the control unit causes the ink filling unit to perform the second ink supply operation after the detection unit detects that the ink amount is smaller than the predetermined amount.

23. The printing apparatus according to claim 18, wherein the control unit causes the ink filling unit to perform the second ink supply operation after the detection unit detects that the ink amount is smaller than the predetermined amount and thereafter a second predetermined amount of ink in the sub tank has been consumed.

24. The printing apparatus according to claim 18, wherein the control unit causes the ink filling unit to perform the second ink supply operation after the detection unit detects that the ink amount is smaller than the predetermined amount and thereafter when the detection unit detects that the ink amount is smaller than a second predetermined amount that is smaller than the predetermined amount.

25. The printing apparatus according to claim 18, wherein the control unit causes the ink filling unit to perform the second ink supply filling operation after the detection unit detects that the ink amount is smaller than the predetermined amount and thereafter when the main tank is detached from the printing apparatus.

26. The printing apparatus according to claim 18, wherein the control unit determines whether to cause the ink filling unit to perform the second ink supply operation based on at least one of an ink supply amount, a type of ink, environmental temperature and environmental humidity at time when an ink remaining amount in the main tank is smaller than the predetermined amount, and the second ink supply operation is performed according to a result of the determination.

* * * * *